US008370963B2

(12) United States Patent
Laliberty

(10) Patent No.: US 8,370,963 B2
(45) Date of Patent: Feb. 12, 2013

(54) SPORT GLOVE

(75) Inventor: Ronald P. Laliberty, Dudley, MA (US)

(73) Assignee: Russell Brands, LLC, Bowling Green, KY (US)

( * ) Notice: Subject to any disclaimer, the term of this patent is extended or adjusted under 35 U.S.C. 154(b) by 316 days.

(21) Appl. No.: 12/862,044

(22) Filed: Aug. 24, 2010

(65) Prior Publication Data

US 2011/0083242 A1 Apr. 14, 2011

(51) Int. Cl.
*A41D 13/08* (2006.01)
*A41D 19/00* (2006.01)

(52) U.S. Cl. ..... 2/19; 2/161.1

(58) Field of Classification Search ..... 2/16, 19, 2/20, 159, 161.1; D29/123; D21/780
See application file for complete search history.

(56) References Cited

U.S. PATENT DOCUMENTS

| | | | | |
|---|---|---|---|---|
| 5,379,459 | A | 1/1995 | Williams, Jr. | |
| 5,671,477 | A * | 9/1997 | Aoki | 2/19 |
| 5,976,036 | A * | 11/1999 | Jackson | 473/458 |
| 6,536,046 | B1 * | 3/2003 | Gilligan | 2/19 |
| D485,950 | S * | 1/2004 | Murai | D29/123 |
| 7,360,254 | B2 * | 4/2008 | Lin et al. | 2/19 |
| 7,389,545 | B2 * | 6/2008 | Lin et al. | 2/19 |
| 2006/0218689 | A1 | 10/2006 | Brown | |

* cited by examiner

*Primary Examiner* — Gloria Hale
(74) *Attorney, Agent, or Firm* — Bradley Arant Boult Cummings, LLP; Jacob W. Neu

(57) ABSTRACT

A baseball glove comprises a palm section, a finger section, a thumb section, and a web section between the fingers and thumb sections. The finger section comprises four finger stalls. The outermost finger stall is wide enough to accommodate two fingers and a rigid insert is inserted into the outermost finger stall.

23 Claims, 7 Drawing Sheets

SPORT GLOVE

BACKGROUND

The present disclosure relates to a new and improved sports glove useful for playing baseball or softball. Several different aspects and embodiments are described. Such gloves may be helpful in protecting a user's hand and are easier for a user to close.

Baseball and softball continue to be popular sports in the United States and abroad. Players on the fielding team wear a glove on one hand to protect their hands and facilitate catching of thrown or batted balls. In particular, the various playing characteristics of the different positions require different glove characteristics for optimal performance. Thus, there are specialty gloves for the various positions: catcher, first baseman, infield, pitcher, and outfield.

The level of protection a glove offers can be improved by thickening the exterior or adding additional interior padding. However, additional materials between the user's hand and the catching surface make it more difficult for the user to close the glove. Making a glove thinner can enhance catching ability but can also increase the likelihood of injury.

There remains a need for sports gloves that facilitate closing of the glove, or trapping of the ball, to make securing of baseballs and softballs easier without sacrificing protection of the hand.

BRIEF DESCRIPTION

The present disclosure relates to sports gloves. The gloves are particularly suited for use in baseball and softball, and in particular are suitable when used as a baseball glove for an outfielder.

In some embodiments, the glove's catching surface is configured to ensnare a regulation sized baseball with a circumference of from about 9 to about 9.25 inches. In other embodiments, the glove's catching surface is configured to ensnare a regulation sized softball with a circumference of about 12 inches.

Disclosed in some embodiments is a sports glove, comprising a thumb section, a finger section, and a palm section. The finger section contains three interior finger stalls and an exterior finger stall. The exterior finger stall is sized to receive two fingers of a user. The finger section and the palm section are separated by an imaginary dividing line defined by three grooves separating the four finger stalls. An insert is located in the exterior finger stall and fixed in place through a lowermost eyelet. The lowermost eyelet of the insert is located on the finger section, not the palm section.

The sports glove can be a baseball glove or a softball glove.

An uppermost eyelet of the insert may be located at most 50 mm from an upper edge of the glove. The insert may have a total of four eyelets. The insert is located inside an exterior finger pad. The exterior finger pad may extend from an upper edge of the glove into the palm section.

The insert may have a length of from about 76 mm to about 178 mm, including a length of from about 105 mm to about 115 mm.

The insert may have a maximum width of from about 30 mm to about 35 mm.

In some embodiments, the glove has a glove length, the insert has an insert length, and the ratio of the glove length to the insert length is from 2 to 3. The ratio may further be from 2.4 to 2.9, or about 2.6.

The sports glove may include a finger strap located below the exterior finger stall, the finger strap comprising a base and two lacing members. The lacing members may have a length of at least 120 mm. The lacing members may otherwise have a length of from 90 mm to about 160 mm. The base may have a length of from about 50 mm to about 90 mm, including a length of about 70 mm. The finger strap may have a total length of from about 170 mm to about 250 mm.

In other embodiments, a sports glove comprises: a rigid insert, a palm section, a finger section, a thumb section, and a web section located between the finger section and the thumb section; wherein the finger section comprises four finger stalls, an outermost finger stall being wide enough to accommodate two fingers; wherein the rigid insert is located in the outermost finger stall; and wherein the rigid insert does not extend into the palm section.

In other embodiments, a baseball glove comprises: a rigid insert, a palm section, a finger section, a thumb section; and a web section between the finger section and the thumb section; wherein the finger section comprises four finger stalls, an outermost finger stall being wide enough to accommodate two fingers; wherein the rigid insert is located inside the outermost finger stall; and wherein the rigid insert extends into the palm section.

In still other embodiments, a baseball glove comprises: a rigid finger insert, a rigid thumb insert, a palm section, a finger section, a thumb section, and a web section between the finger section and the thumb section; wherein the finger section comprises four finger stalls, an outermost finger stall being sized to accommodate two fingers; wherein the rigid finger insert is located in the outermost finger stall, the rigid thumb insert is located in the thumb stall, the rigid thumb insert extends into the palm section, and the rigid finger insert does not extend into the palm section.

Also disclosed is a sports glove comprising: a rigid insert, a palm section, a fingers section, a thumb section, a reinforcing section between the fingers section and the thumb section, and a padding layer; wherein the thumb section comprises a thumb stall; wherein the fingers section comprises four finger stalls; wherein an outermost finger stall is wide enough to accommodate two fingers; and wherein the rigid insert is located inside the padding layer and the padding layer is located inside the outermost finger stall.

In further embodiments is disclosed a sports glove, comprising: a front shell and a back shell; wherein a thumb stall and four finger stalls are formed between the front shell and the back shell; wherein an outermost finger stall is sized to accommodate two fingers; a rigid insert having a lowermost eyelet is located inside the outermost finger stall; wherein three grooves separating the four finger stalls define an imaginary dividing line separating a palm section from the four finger stalls; and wherein the lowermost eyelet of the insert is not located on the palm section.

BRIEF DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
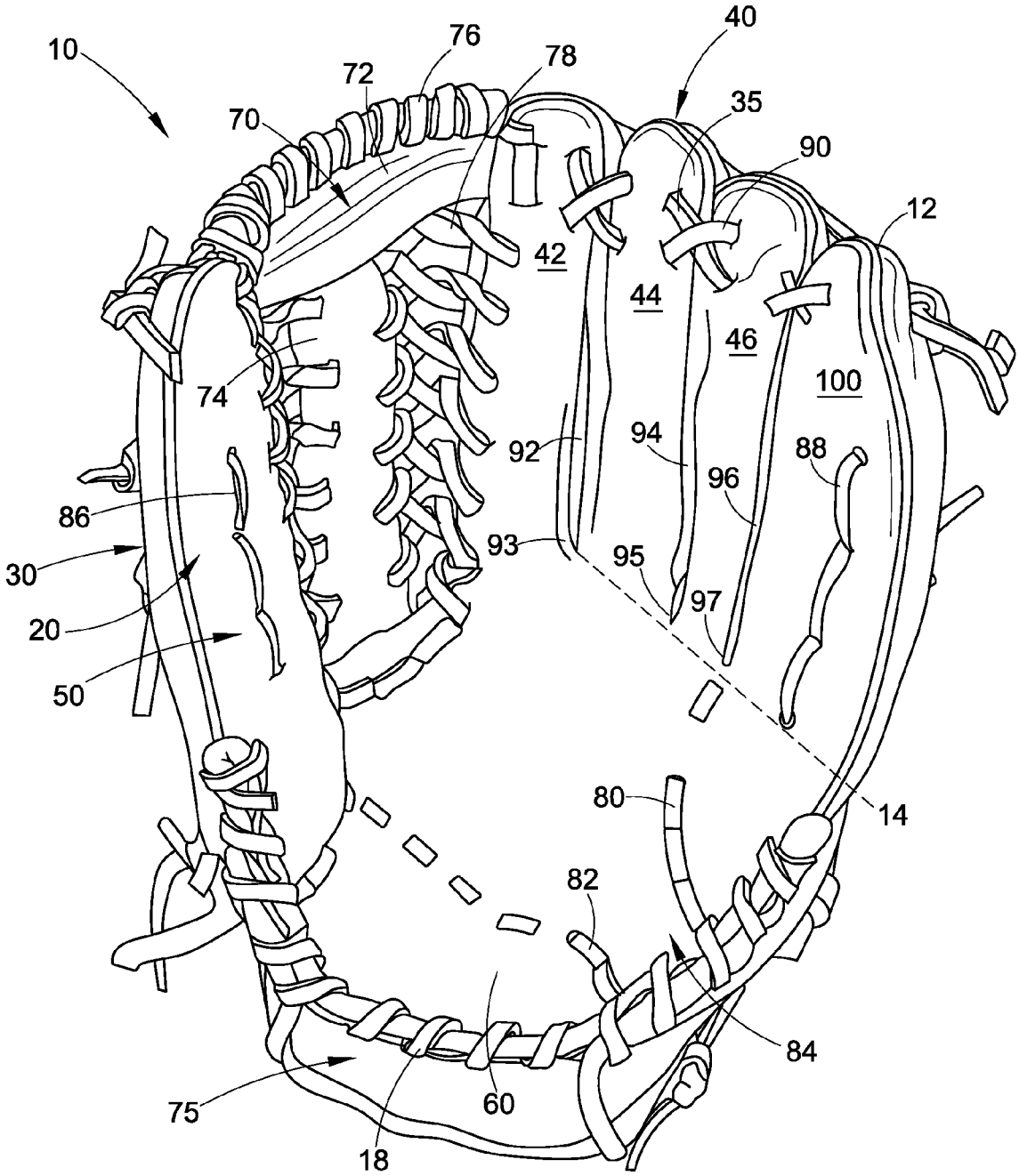
FIG. 1 is a perspective exterior view of a sports glove of the present disclosure.

A more complete understanding of the components, processes, and apparatuses disclosed herein can be obtained by reference to the accompanying figures. These figures are merely schematic representations based on convenience and the ease of demonstrating the present development and are, therefore, not intended to indicate the relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also disclosed the range "from 2 to 4."

FIG. 1 is a perspective exterior view showing the various parts of the sports glove of the present disclosure. Glove 10 has a front shell 20 and a back shell 30. Front shell 20 is joined to back shell 30 internally and in various locations by lacing. The joining of shells 20 and 30 create the essential format of the glove, specifically, finger section 40, thumb section 50, and palm section 60. Disposed between finger section 40 and thumb section 50 is a web section 70. Web section 70 can be made in several ways. As shown here, the web section is depicted as being made up of first and second leather web elements 72 and 74, stitched together to form a T-shape. This T-shaped element is secured to the finger section 40 and thumb section 50 by top web lacing 76, and additional web lacing 78 completes the web section. In another embodiment (not shown), only second web element 74 is present. Top web lacing 76 forms the top of the T-shape secures the second web element to the finger section 40 and thumb section 50, and web lacing 78 is also present.

The finger section 40 contains four finger stalls 42, 44, 46, 100. Three finger stalls 42, 44, 46 may be considered interior finger stalls. The fourth finger stall 100 can be considered the outermost finger stall or the exterior finger stall. The four finger stalls are separated by three grooves 92, 94, 96. The grooves begin at an upper edge 12 of the glove 10 and extend inwards. The three grooves terminate at the palm section 60 of the glove. Put another way, the ends 93, 95, 97 of the three grooves can be considered as defining an imaginary dividing line 14 between the finger section 40 and the palm section 60. The exterior finger stall 100 differs from the three interior finger stalls 42, 44, 46 in that the exterior finger stall is sized (i.e. is wide enough) to accommodate both the little finger and the ring finger, not just one finger. The four finger stalls are joined together by top finger lacing 90.

Along the palm section 60 are lower finger lacing 80 and palm lacing 82. These two lacings together form a hinge assembly 84 so that the player can flex finger section 40 and thumb section 50 towards each other and close glove 10 around a caught ball. In addition, thumb lacing 86 and exterior finger lacing 88 are shown on the thumb section 50 and exterior finger stall 100, respectively.

The joining together of shells 20 and 30 also creates opening 75 below palm section 60. It is through opening 75 that a baseball player can insert his/her hand so as to be able to use glove 10 while playing baseball.

Figure 2:
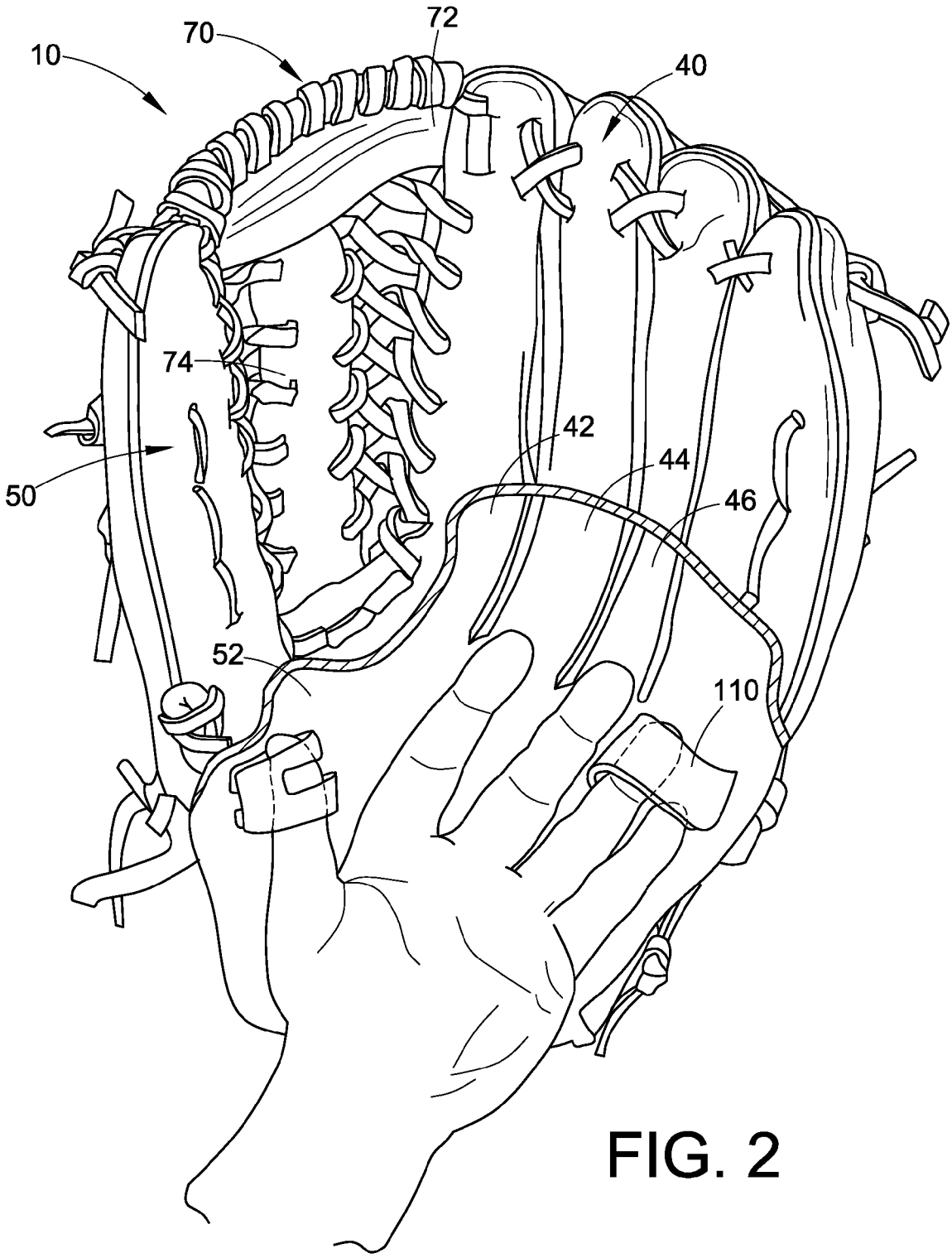
FIG. 2 is a cutaway interior view of a sports glove of the present disclosure.

FIG. 2 is a cutaway interior view of the sports glove. When the person's hand is inserted into the sports glove, the person's four fingers and one thumb are usually each received into their own individual finger stall. We note that, as seen in FIG. 2, the person's fingers do not actually extend entirely into each finger stall. Rather, the majority of the person's hand and fingers remain in the palm section 60, and only the tips might extend beyond imaginary dividing line 14 into the finger section 40.

Located inside palm section 60 is a finger strap 110. The finger strap is located below exterior finger stall 100 and is sized to receive two fingers therethrough. Thumb section 50 includes a thumb stall 52.

As previously noted, the exterior finger stall 100 is sized to receive two fingers. A player can apply a greater force to close the glove when s/he has two fingers in the outermost finger stall than could be applied using the little finger alone. When a user places two fingers in the outermost finger stall 100, the user can place the index and middle fingers in the unoccupied finger stalls in whatever manner provides the most comfort.

Figure 3:
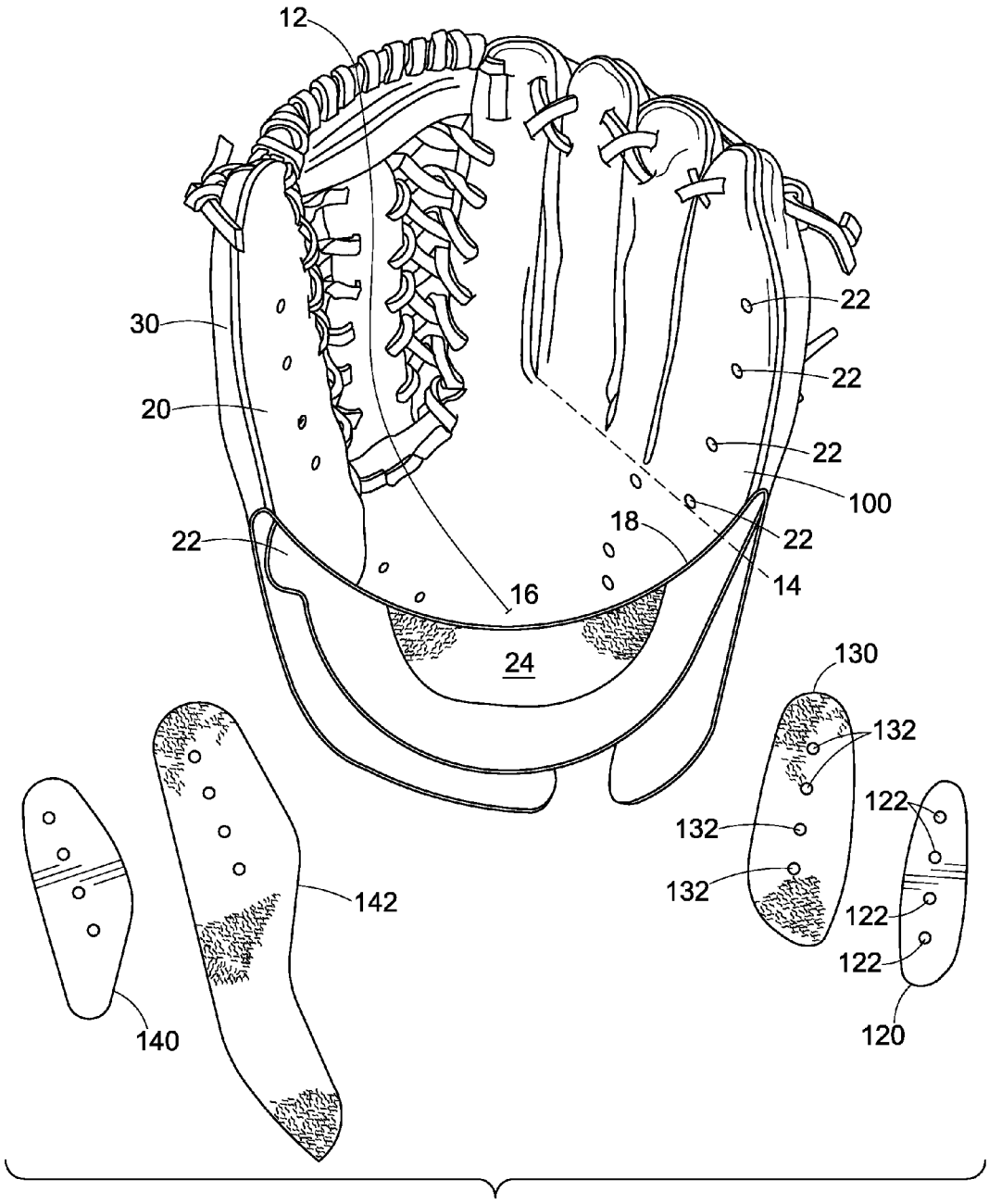
FIG. 3 is a perspective view of a partially disassembled sports glove of the present disclosure.

FIG. 3 is a perspective view of a partially disassembled sports glove of the present disclosure. An intermediate shell 22 is located between front shell 20 and back shell 30. Generally, the space between front shell 20 and intermediate shell 22 is used for padding and other construction, while the space between intermediate shell 22 and back shell 30 is where the user's hand is located. We note that the references to the finger section 40, thumb section 50, palm section 60, thumb stall 52, and finger stalls 42, 44, 46, 100 do not distinguish between these two spaces and should not be considered as being limited by this description of the construction of the baseball glove.

Palm padding 24 is located on the palm section to cushion the user's hand against the impact of a high-velocity ball. The palm padding can be a sponge or sponge-like material. An insert or rigid finger insert 120 is located inside exterior finger pad or padding layer 130. The assembly of insert 120 and exterior finger pad 130 is then inserted into the exterior finger stall 100 between front shell 20 and intermediate shell 22. Put another way, the assembly of insert 120 and exterior finger pad 130 is located inside or located within the exterior finger stall 100. Similarly, a rigid thumb insert 140 is inserted between thumb padding 142 and inserted into thumb section 50.

As seen in FIG. 3, insert 120 has four eyelets 122, exterior finger pad 130 has four eyelets 132, and the glove has four eyelets 22. These eyelets are all aligned with each other so that exterior finger lacing 88 can be wound through them to hold these glove elements in place. When this disclosure refers to eyelets in a particular location, it should be considered as referring to any of these eyelets, separately or together, as being in that particular location.

Figure 4:
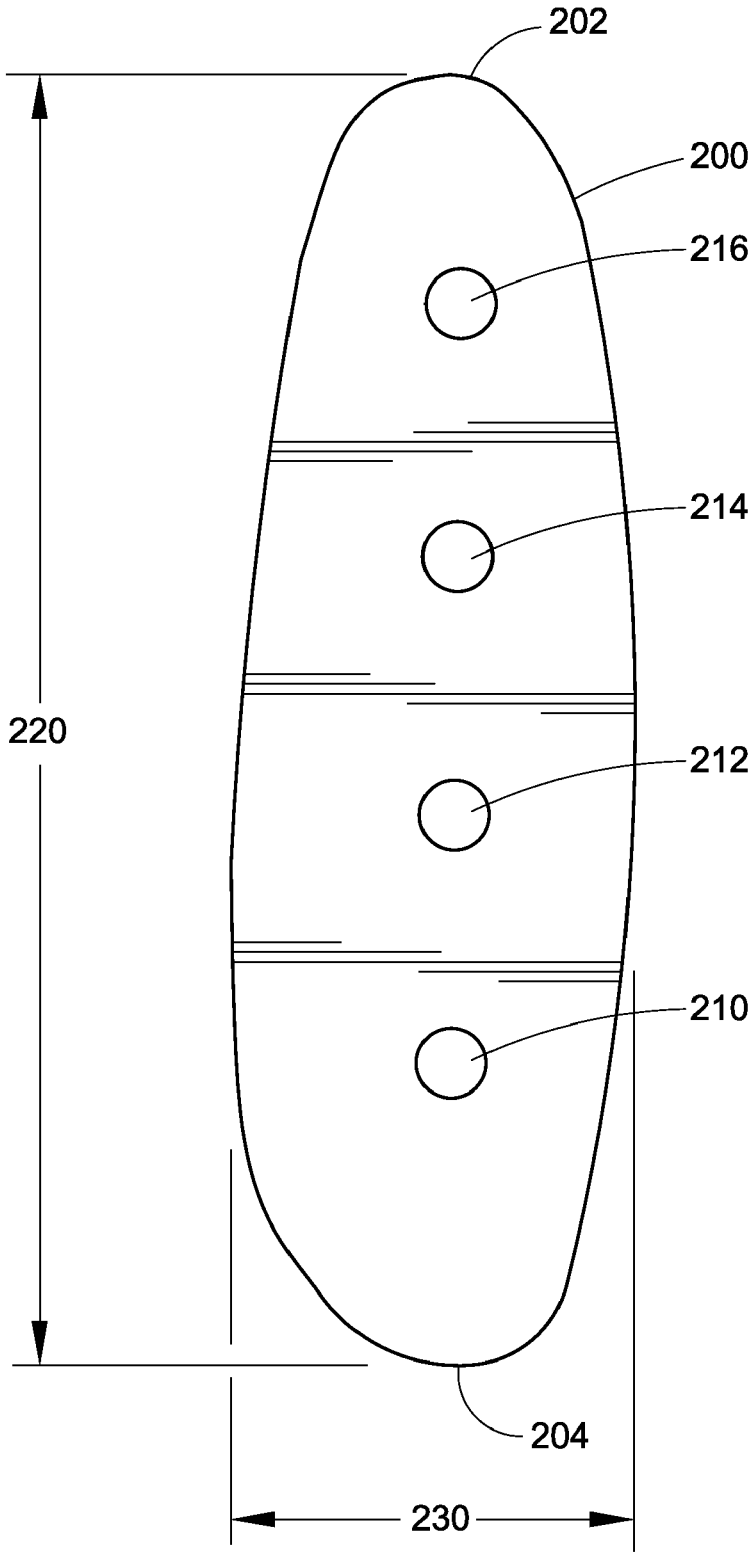
FIG. 4 is a top view of a finger insert used in the present disclosure.

FIG. 4 is a top view of the finger insert 200 of the present disclosure. Generally, the finger insert 200 is sized to be shorter than it would otherwise be in a glove designed to fit only one finger in the outermost finger stall. In addition, the eyelets are moved closer to the upper edge 12 of the glove. This results in the lowermost eyelet 210 of the insert 200 being located on the finger section 40, rather than on the palm section 60. Reducing the penetration of the insert 200 into the palm section 60 creates more space for the two fingers in the outermost finger stall 100.

In particular embodiments, the lowermost eyelet 210, closest to the palm section 60, is from about 5 to about 25 mm away from the palm section 60 (i.e. from imaginary dividing line 14). In a specific embodiment, the distance between the lowermost eyelet 210 and the palm section 60 is about 10 mm. It should be noted however, that the exterior finger pad 130 may extend from the upper edge 12 of the glove into the palm section 60, separate from the insert 200 itself.

Generally, there are four eyelets 210, 212, 214, 216 on the insert 200. As noted, the eyelets also move closer to the upper edge 12 of the glove. In embodiments, the uppermost eyelet 216 is located at most 50 mm from the upper edge 12 of the glove. The axis passing through the center of the four eyelets defines the length 220 of the insert. The insert may have a length 220 of from about 76 mm to about 178 mm. In particular embodiments, the insert has a length of from about 105 mm to about 115 mm. The axis perpendicular to the length defines the width 230 of the insert. The insert may have a width 230 of from about 15 mm to about 50 mm. In particular embodiments, the insert has a maximum width of from about 30 mm to about 35 mm.

In some particular embodiments, about 9.5 mm are cut off the top end 202 of the insert and about 14.3 mm are cut off the bottom end 204 of the insert, compared to the size of the insert when only one finger is intended to be placed in the exterior finger stall, for a total reduction in length of about 23.8 mm. In other particular embodiments, the eyelets are located on the insert so that the insert 200 itself does not extend into the palm section 60 (i.e. beyond imaginary dividing line 14). It is contemplated that the size and shape of the insert will be constant for all glove sizes.

In some particular embodiments, the finger insert 120 does not extend into the palm section 60, while the thumb insert 140 does extend into the palm section 60.

The size of a baseball glove is typically measured as the length 16 from the base 18 of the glove to the top of the glove along the web section and following the curve of the glove, as seen in FIG. 3. The number printed on a glove usually represents this length measurement. For example, a glove with "11½ INCH PATTERN" is a glove with a length of 11½ inches. Glove sizes range from size 9 (for youth) to size 14 (for softball). It should be understood that the relative sizes and lengths discussed herein vary depending on the glove size.

In other embodiments, the ratio of the glove length 16 to the insert length 220 is from 2 to 3, including from 2.4 to 2.9, and in particular embodiments about 2.6.

The finger insert 200 may be made from a rigid polymeric material such as polyethylene, polypropylene, and any other plastic material. The thumb insert 140 can also be made in the same way.

Figure 5:
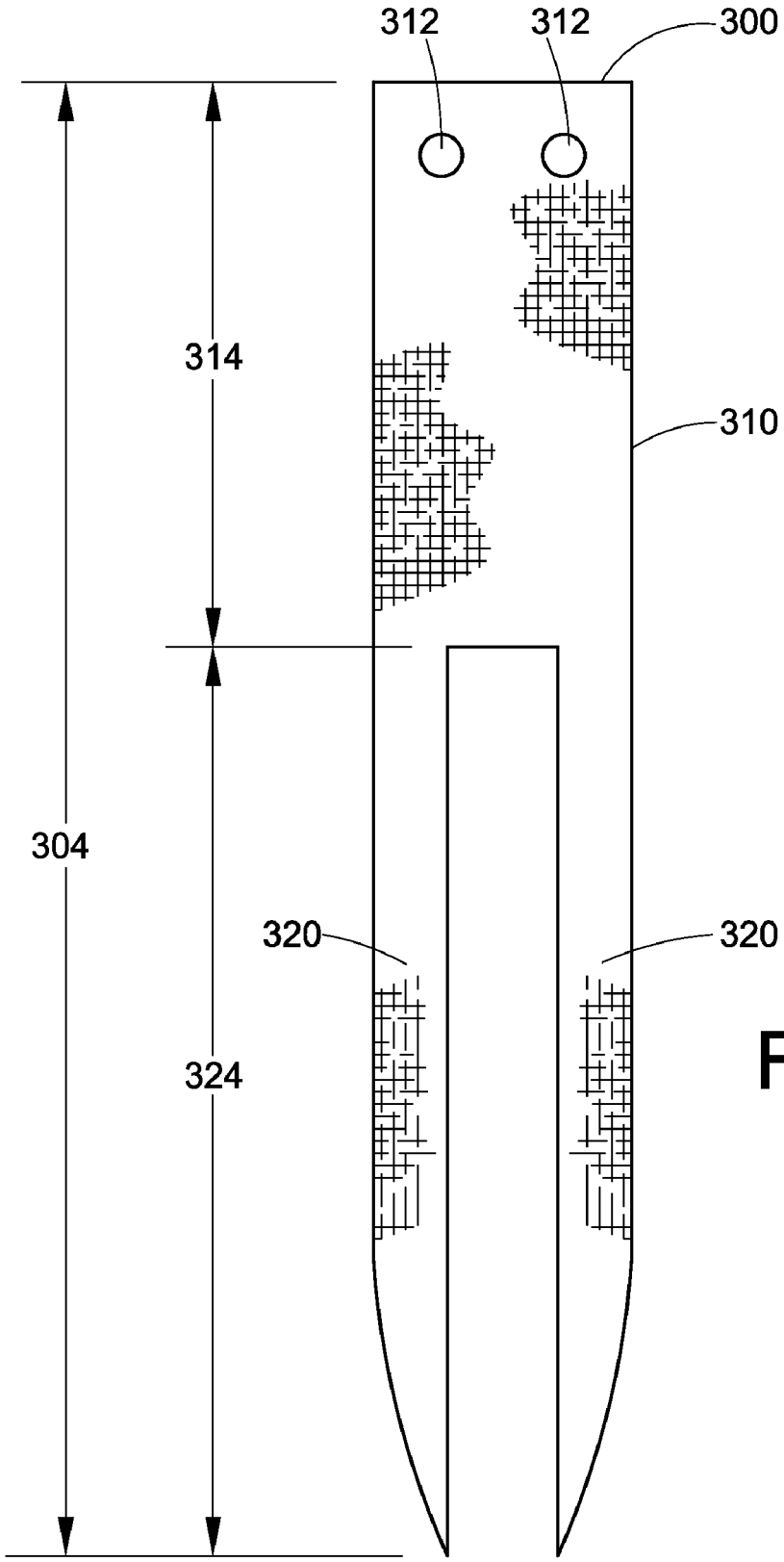
FIG. 5 is a top view of a finger strap used in the present disclosure

FIG. 5 is a top view of a finger strap 300 used in the present disclosure. This finger strap is located beneath the exterior finger stall 100 between the intermediate shell 22 and the back shell 30. The finger strap 300 comprises a base 310 and two lacing members 320. The base 310 may have two eyelets 312 punched through it for lacing to pass through, although the base is typically sewed onto the intermediate shell 22. As is known and not depicted, a portion of the base is sewed in place, then the remaining base and lacing members are folded back to form a loop, and the lacing members then pass through eyelets to the exterior of the glove.

The base 310 has a length 314 of from about 50 mm to about 90 mm, depending on the size of the glove. In particular embodiments, for a size 11.5 glove, the base has a length of about 70 mm. The lacing members 320 have a length 324 of from about 90 mm to about 160 mm, depending on the size of the glove. In particular embodiments, for a size 11.5 glove, the lacing members have a length 324 of at least 120 mm. The size of the opening for the fingers created by the finger strap 300 is changed by adjusting the lacing members. The lacing members are then tied to each other on the exterior of the glove when the user is satisfied with the fit. The finger strap 300 may have a total length 304 of from about 170 mm to about 250 mm.

Figure 6:
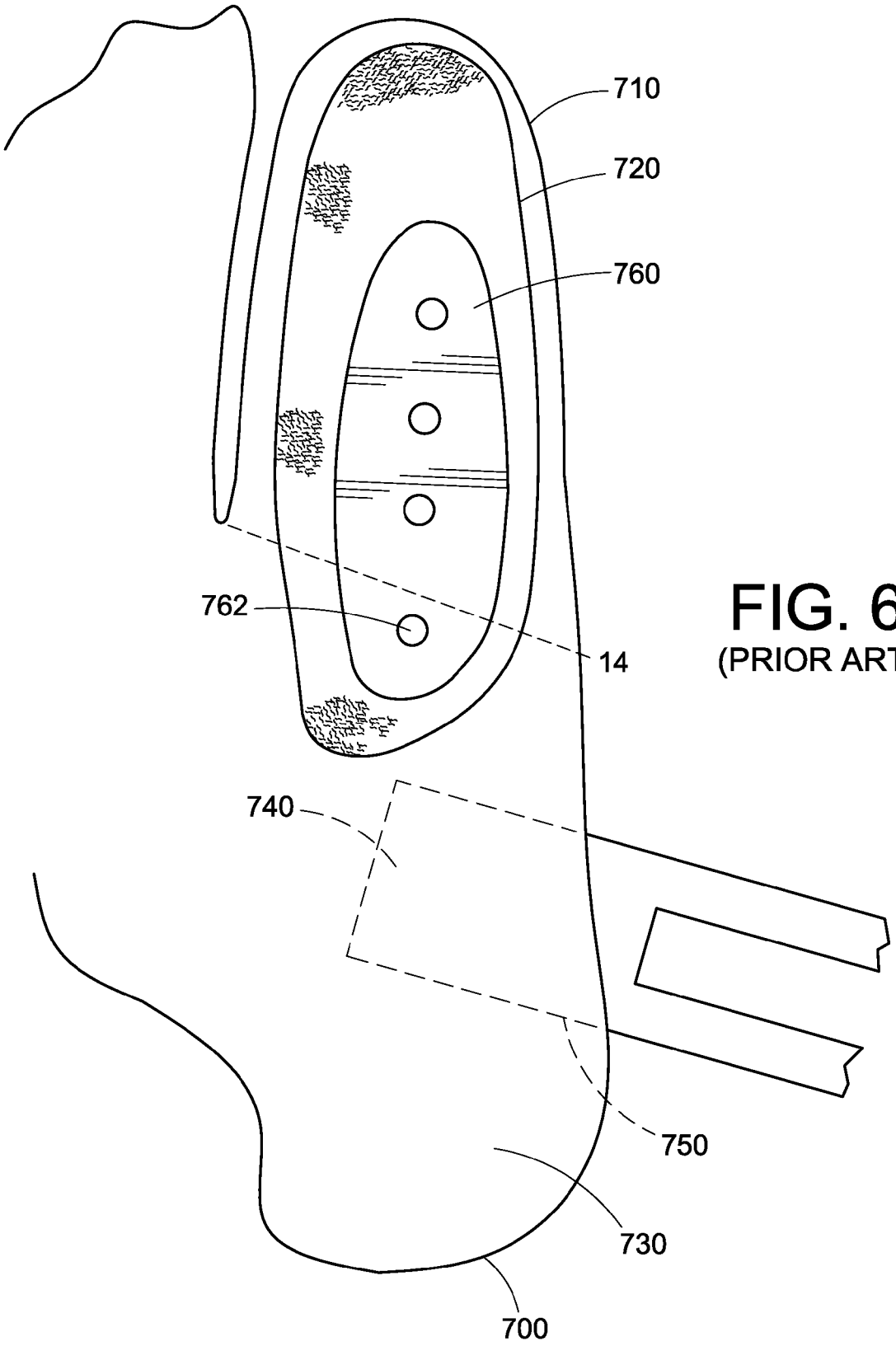
FIG. 6 (PRIOR ART)
FIG. 6 is a cross-sectional view of the various layers of a prior art glove.

FIG. 6 is a cross-sectional view of the outermost finger stall 710 and palm section 730 of a prior art glove 700. Padding 720 is inserted into the outermost finger stall 710. An insert 760 is also shown that extends into palm section 730, with lowermost eyelet 762 also being in the palm section 730. The base 740 of the finger strap 750 is not large enough to comfortably accommodate two fingers. The depth to which the insert 760 extends into the palm section 730 also makes it difficult to fit two fingers into the outermost finger stall 710.

Figure 7:
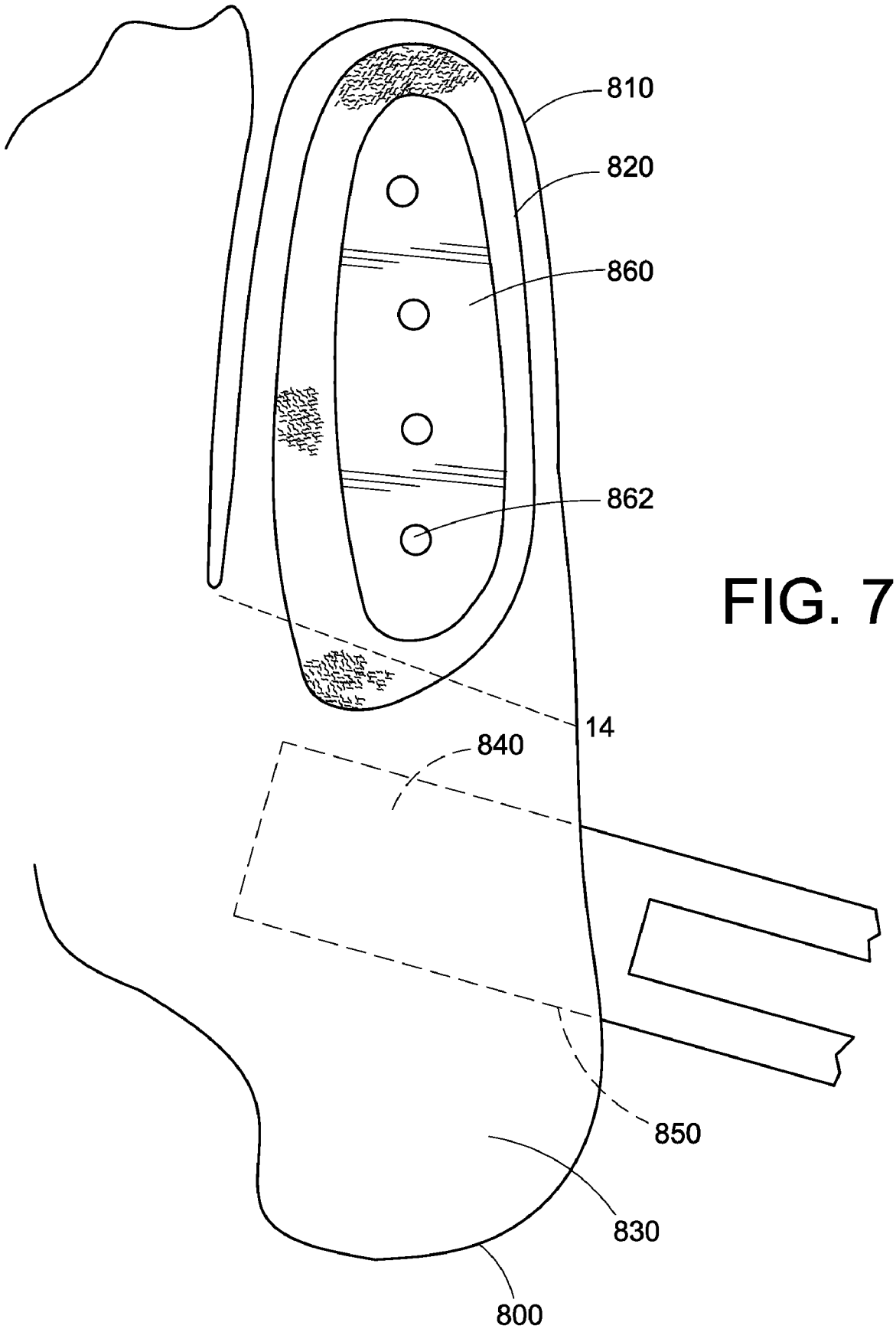
FIG. 7 is a cross-sectional view of the various layers of a glove of the present disclosure.

FIG. 7 is a cross-sectional view of the outermost finger stall 810 and palm section 830 of an exemplary embodiment of a glove 800 of the present disclosure. Padding 820 is inserted into the outermost finger stall 810. The padding 820 extends slightly into the palm section 830. A rigid insert 860 is located within the padding 820. The rigid insert 860 does not extend into the palm section, and the lowermost eyelet 862 is on the finger section, i.e. not on the palm section 830. These alterations expand the space available to fit a user's fingers. The length of the base 840 of the finger strap 850 is increased to more easily fit two fingers.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A sports glove, comprising:

a thumb section, a finger section, and a palm section;

the finger section containing three interior finger stalls and an exterior finger stall;

the exterior finger stall comprising multiple eyelets and being sized to receive two fingers of a user;

the finger section and the palm section being separated by an imaginary dividing line intersecting the ends of three grooves separating the four finger stalls;

an insert comprising multiple eyelets located in the exterior finger stall and fixed in place by lacing through the lowermost eyelet of the insert and the lowermost eyelet of the exterior finger;

wherein the lowermost eyelet of the insert is located on the finger section.

2. The sports glove of claim 1, wherein an uppermost eyelet of the insert is located at most 50 mm from an upper edge of the glove.

3. The sports glove of claim 1, wherein the insert has a total of four eyelets.

4. The sports glove of claim 1, wherein the insert is located inside an exterior finger pad positioned within the exterior finger stall.

5. The sports glove of claim 4, wherein the exterior finger pad extends from an upper edge of the glove into the palm section.

6. The sports glove of claim 1, wherein the insert has a length of from about 76 mm to about 178 mm.

7. The sports glove of claim 1, wherein the insert has a length of from about 105 mm to about 115 mm.

8. The sports glove of claim 1, wherein the insert has a maximum width of from about 30 mm to about 35 mm.

9. The sports glove of claim 1, wherein the glove has a glove length, the insert has an insert length, and the ratio of the glove length to the insert length is from 2 to 3.

10. The sports glove of claim 9, wherein the ratio of the glove length to the insert length is from 2.4 to 2.9.

11. The sports glove of claim 9, wherein the ratio of the glove length to the insert length is about 2.6.

12. The sports glove of claim 1, wherein the insert is made from a rigid polymeric material.

13. The sports glove of claim 1, further comprising a finger strap located below the exterior finger stall, the finger strap comprising a base and two lacing members.

14. The sports glove of claim 13, wherein the lacing members having a length of at least 120 mm.

15. The sports glove of claim 13, wherein the lacing members of a length of from 90 mm to about 160 mm.

16. The sports glove of claim 13, wherein the base has a length of from about 50 mm to about 90 mm.

17. The sports glove of claim 13, wherein the base has a length of about 70 mm.

18. The sports glove of claim 13, wherein the finger strap has a total length of from about 170 mm to about 250 mm.

19. A sports glove, comprising:

a palm section, a finger section, a thumb section, and a web section located between the finger section and the thumb section, said sections configured in the shape of a glove;

wherein the finger section comprises four finger stalls, an outermost finger stall being wide enough to accommodate two fingers;

wherein a rigid insert is located in the outermost finger stall; and wherein the rigid insert does not extend into the palm section.

20. A baseball glove, comprising:

a palm section, a finger section, a thumb section, and a web section between the finger section and the thumb section, said sections configured in the shape of a glove;

wherein the finger section comprises four finger stalls, an outermost finger stall being wide enough to accommodate two fingers;

wherein a rigid insert is located inside the outermost finger stall; and wherein the rigid insert extends into the palm section.

21. A baseball glove, comprising:

a rigid finger insert, a rigid thumb insert, a palm section, a finger section, a thumb section, and a web section between the finger section and the thumb section;

wherein the finger section comprises four finger stalls, an outermost finger stall being sized to accommodate two fingers;

wherein the rigid finger insert is located in the outermost finger stall, the rigid thumb insert is located in the thumb stall, the rigid thumb insert extends into the palm section, and the rigid finger insert does not extend into the palm section.

22. A sports glove, comprising:

a rigid insert, a palm section, a fingers section, a thumb section, a reinforcing section between the fingers section and the thumb section, and a padding layer; fingers; and wherein the thumb section comprises a thumb stall;

wherein the fingers section comprises four finger stalls;

wherein an outermost finger stall is wide enough to accommodate two fingers; and wherein the rigid insert is located inside the padding layer and the padding layer is located inside the outermost finger stall.

23. A sports glove, comprising:

a front shell and a back shell;

wherein a thumb stall and four finger stalls are formed between the front shell and the back shell;

wherein an outermost finger stall is sized to accommodate two fingers;

a rigid insert having a lowermost eyelet is located inside the outermost finger stall;

wherein three grooves separating the four finger stalls define an imaginary dividing line separating a palm section from the four finger stalls; and wherein the lowermost eyelet of the insert is not located on the palm section.

* * * * *